US005697312A

United States Patent [19]

Gustafsson et al.

[11] Patent Number: 5,697,312

[45] Date of Patent: Dec. 16, 1997

[54] GAS TANKER

[75] Inventors: Jukka Gustafsson, Mynämäki; Jukka Linja, Merimasku; Jarmo Mäkinen, Aura, all of Finland

[73] Assignee: Kvaerner Masa-Yards Oy, Helsinki, Finland

[21] Appl. No.: 645,282

[22] Filed: May 13, 1996

[30] Foreign Application Priority Data

May 12, 1995 [FI] Finland ..... 952325

[51] Int. Cl.[6] ..... B63B 25/16

[52] U.S. Cl. ..... 114/74 A; 220/562; 220/584; 220/901

[58] Field of Search ..... 114/74 R, 74 A; 220/562, 584, 901

[56] References Cited

U.S. PATENT DOCUMENTS

| | | | |
|---|---|---|---|
| 2,048,312 | 7/1936 | Zulver . | |
| 3,842,775 | 10/1974 | Edwards et al. | 114/74 A |
| 3,894,505 | 7/1975 | Murphy . | |
| 4,181,235 | 1/1980 | Baysinger | 220/5 A |
| 4,672,906 | 6/1987 | Asai . | |

FOREIGN PATENT DOCUMENTS

| | | | |
|---|---|---|---|
| 0 422 752 | 4/1991 | European Pat. Off. . | |
| 241293 | 10/1986 | Japan | 114/74 A |
| 818073 | 8/1959 | United Kingdom . | |
| 95/20519 | 8/1995 | WIPO . | |

*Primary Examiner*—Sherman Basinger
*Attorney, Agent, or Firm*—Smith-Hill and Bedell

[57] ABSTRACT

A large ship comprises a hull and several cargo tanks. Each cargo tank has substantially semi-spherical bottom and top portions; the bottom portions of the tanks and the top portions of tanks all being of substantially equal radius of curvature. At least one tank has a substantially cylindrical intermediate portion that interconnects the bottom and top portions of the tank and is of substantially equal radius of curvature to the bottom and top portions of the tanks.

21 Claims, 2 Drawing Sheets

GAS TANKER

BACKGROUND OF THE INVENTION

This invention relates to a large ship.

In a ship used for transport of liquefied natural gas (LNG), commonly known as an LNG carrier, the liquefied gas is normally enclosed in large spherical tanks having a diameter of about 40 m. Manufacturing methods and structures for such spherical tanks are disclosed for example, in U.S. Pat. No. 5,484,098 and U.S. Pat. No. 5,441,196 and in Application Publication EP 708326.

In an LNG carrier of this kind, the hull of the carrier accommodates several spherical tanks, usually 3 to 6 in line in front of the bridge of the carrier. Each tank is composed of top and bottom portions that are substantially semi-spherical, i.e. having approximately the form of half a sphere, and an equator profile therebetween. The tanks are made as large as possible within the limits of the carrier's dimensions. Consequently, the upper portions of the tanks extend quite high above the bulwarks of the ship and may obstruct the line of sight forwards from the bridge, even though the bridge itself is well above the bulwarks.

Liquefied natural gas (LNG) has a temperature of about −163° C. This very low temperature places special demands on the choice of material for manufacture of tanks for transportation of LNG and on the techniques used in production of such tanks. Accordingly, the production facilities for manufacture of large spherical tanks suitable for marine transportation of LNG are very expensive.

For reasons of transport economy, it is desirable to maximize the cargo capacity of an LNG carrier. However, the route of the carrier and the loading and unloading ports set some definite limits to the dimensions of the carrier. Hence, it is not usually possible to increase the number of cargo tanks, and cargo capacity can be increased only by changing the size of the cargo tanks, which gives rise to practical restrictions. Thus, if a tank manufacturer has production facilities for manufacturing a spherical tank of a certain size, manufacture of a spherical tank with another radius of curvature would demand a large investment, because forming molds, assembly jigs and auxiliary means for welding, etc. are designed for a certain size of spherical tank. Producing an arcuate tank with parts having a different radius of curvature, as suggested in EP 422752, would therefore cause unreasonable high costs.

SUMMARY OF THE INVENTION

The object of the invention is to provide an LNG carrier in which the load capacity of the tanks has been increased remarkably without substantial changes in the production means used for manufacturing a certain size of spherical or part-spherical tanks. The invention is also applicable to a carrier for transporting other materials, particularly liquefied gases, such as liquefied petroleum gas (which has a somewhat higher temperature than LNG). Therefore, reference in this specification to the invention being applicable to an LNG carrier are not intended to have a limiting effect on the scope of the claims.

In accordance with the invention, a large ship comprises a hull and at least first and second cargo tanks each having substantially semi-spherical bottom and top portions, the bottom portions and the top portions of the first and second tanks being of substantially equal radius of curvature, and wherein at least the second tank has an intermediate portion that is substantially cylindrical and of substantially equal radius of curvature to the bottom and top portions of the first and second tanks and interconnects the bottom and top portions of the second tank.

Because the semi-spherical top and bottom portions of the two tanks are of the same radius of curvature, the same production facilities can be used for manufacturing the top and bottom portions of the first tank and the top and bottom portions of the second tank and the increase in the cargo capacity of the first and second tanks relative to two spherical tanks of the same radius of curvature is achieved without the large investment required to produce part-spherical tanks with portions having a different radius or curvature. The invention does not affect negatively the strength of the vessel, nor its main dimensions nor the line of sight forwards from the bridge.

By means of the invention, the cargo capacity of a typical LNG carrier with four tanks (length approximately 289 m, beam approximately 48 m) may be increased by more than 10 percent, that is, by approximately 15,000 cubic meters. Regardless of that, it is not necessary to make essential changes in the hull of the carrier. The manufacture of a tank with a relatively short cylindrical intermediate portion between two semi-spherical portions is relatively simple.

In a preferred embodiment of the invention, the height of the intermediate portion of the second tank is 2–15 percent, preferably 4–8 percent, of its diameter. Keeping the height of the intermediate portion within this range normally excludes unexpected strength problems.

The intermediate portion of the second tank is preferably placed on top of a conventional so-called equator profile element, which is connected to the upper edge of the bottom portion of the tank. The equator profile is carried by supporting structures in the hull of the carrier and supports, via a support flange, the entire tank. The supporting structures do not have to be changed substantially, except for some dimensional modifications in order to provide the necessary strength required by the increased tank load.

It is recommended that the semi-spherical portions of the cargo tanks have an inner radius of at least 15 m, preferably at least approximately 20m. This corresponds to today's tank manufacturing technology so that no surprising difficulties are to be expected.

In an LNG carrier the cargo tanks are situated in front of the carrier's bridge and in a row in a longitudinal direction of the carrier. If the foremost tank is a conventional spherical tank, then higher tanks can be placed closer to the bridge, without obstructing the line of sight forwards. The tank with the greatest height is preferably placed closest to the bridge. If the tanks behind the foremost tank are provided each with a cylindrical intermediate portion of different height, it is advantageous to arrange the tanks so that the lower tanks are in front of the higher tanks. This allows the cargo capacity of the carrier to be maximized without obstructing the line of sight from the bridge over the foremost tank.

The tanks are preferably made of aluminum plates. In tank manufacture it is advantageous to optimize the use of material, so that thinner plates are normally used in the top portion of the tank than in its bottom portion, because the tank contents cause a different load at different levels. The plate thickness of the thinner plates is normally at least 20 mm, preferably at least 30 mm. The thickness of the plates may vary also within a given semi-spherical tank portion, such that thinner plates are used at higher tank zones. It is preferred that in an embodiment of the invention, the plate thickness of the cylindrical intermediate portion is greater than or equal to the minimum plate thickness in the top portion of the tank and smaller than or equal to the maximum plate thickness in the bottom portion of the tank.

BRIEF DESCRIPTION OF THE DRAWINGS

An embodiment of the invention will now be described, more in detail, with reference to the accompanying drawings, in which FIG. 1 schematically shows an LNG carrier according to the invention, FIG. 2 schematically shows, partly in section, the cargo tank closest to the bridge of the carrier according to FIG. 1.

DETAILED DESCRIPTION

Figure 1:
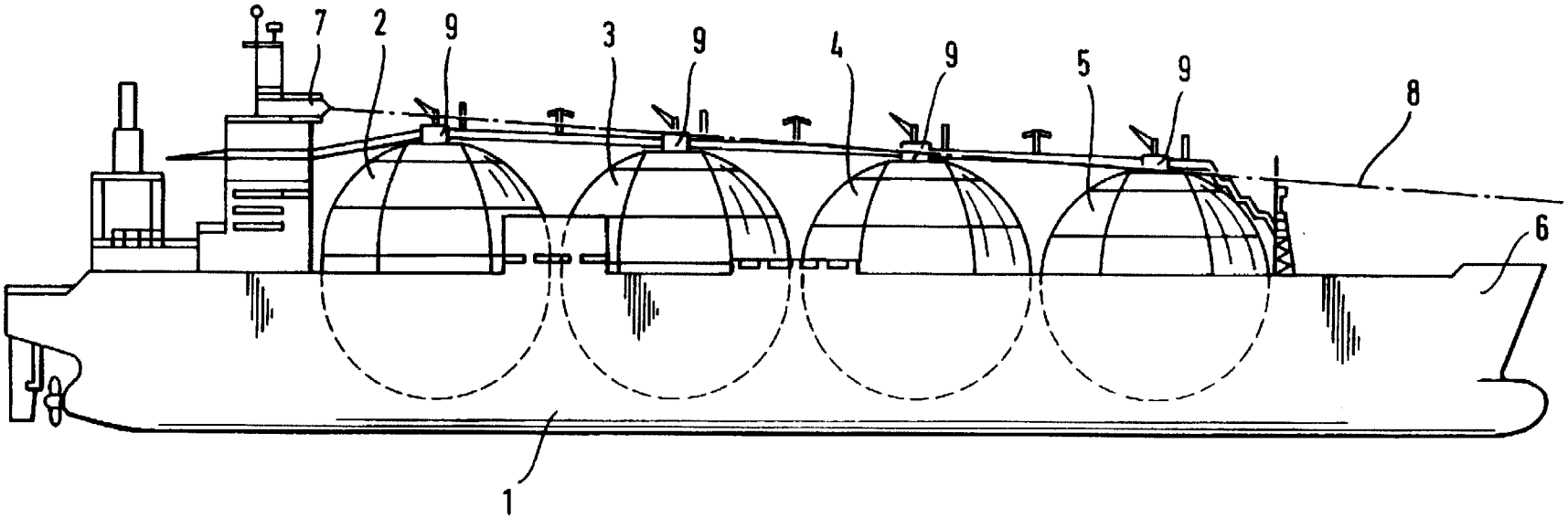

In the drawings, 1 indicates an LNG carrier according to the invention with a length of almost 300 m. The carrier has a conventional ship's bridge 7, from where the carrier is maneuvered. In front of the bridge 7 there are, in a row, cargo tanks 2, 3, 4 and 5. The foremost tank 5 closest to the bow 6 of the carrier 1, is a conventional spherical tank with a diameter of about 40 m. In accordance with the invention, the cargo tanks 2, 3 and 4 are each provided with an intermediate portion. The intermediate portions of the three tanks 2, 3, and 4 are of different respective heights. Each cargo tank has a conventional insulation layer (not shown in detail).

A line 8 shows the lowest line of sight forwards from the bridge 7, which is of conventional height, over the upper surface of the foremost cargo tank 5. The tanks have cargo loading and unloading devices 9 at their upper portions. These devices do not substantially interfere with the view forward over the foremost tank 5. Although the tanks 2, 3 and 4 are, as shown, heightened by means of an intermediate portion, they do not form an obstacle rising above the line of sight 8.

Figure 2:
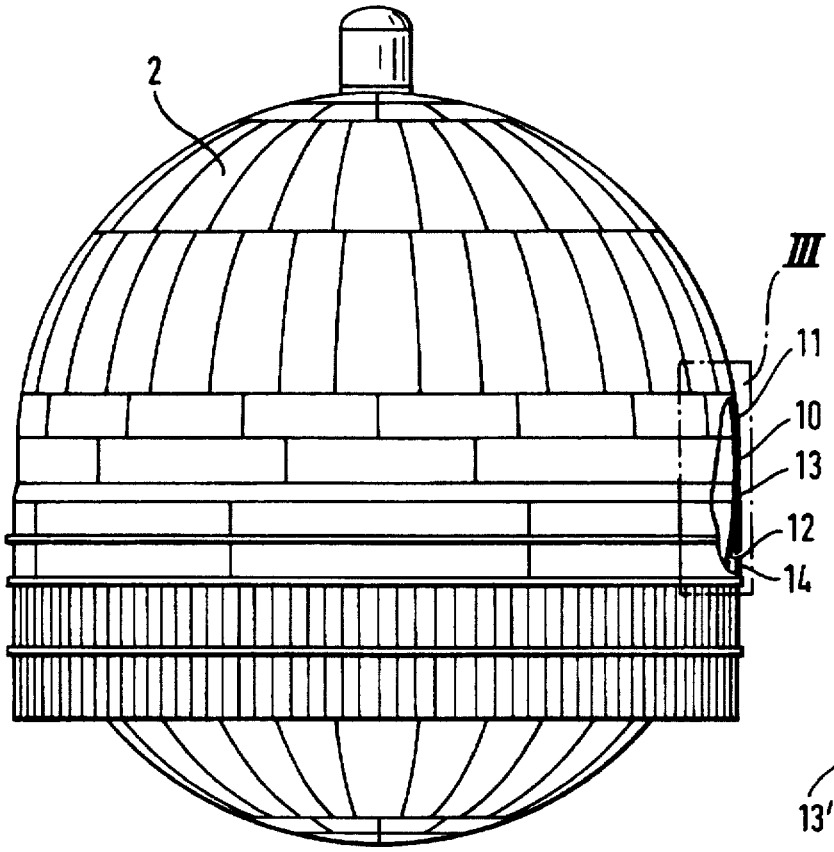

FIG. 2 shows the carrier's largest cargo tank 2. In accordance with the invention, the tank 2 has an intermediate portion 10 between its top portion 11 and its bottom portion 12. The intermediate portion has a height of about 5 m. The general shape of the intermediate portion 10 is a cylindrical, annular plate. This is advantageous with respect to the strength as well as the manufacture of the tank.

The top portion 11 of the tank 2 is semi-spherical. The shape and size of the bottom portion 12 of the tank is similar, but it is manufactured of thicker plates. Both the top portion 11 and the bottom portion 12 are manufactured by welding of aluminum plates. As used herein, in relation to the material of weldable plates, the term aluminum includes an alloy of aluminum.

Figure 3:
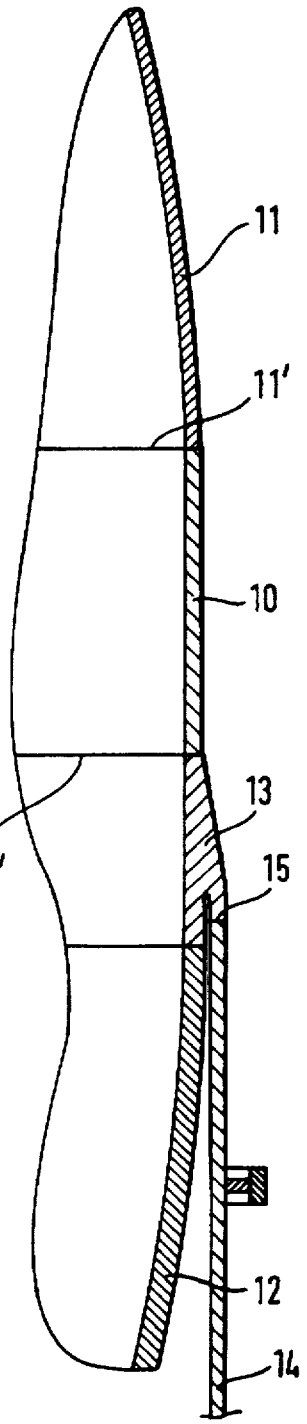
FIG. 3 shows an enlargement of the sectioned area III of FIG. 3.

FIG. 3 shows that the intermediate portion 10 is between the upper edge 13' of the conventional equator profile 13 and the lower edge 11' of the top portion 11 of the tank and is connected to these by welding. FIG. 3 also shows the skirt 14, which is supported in the hull of the carrier and on which the body of the tank is supported through a support flange 15 of the equator profile. The height of the equator profile 13 is usually about 1 m and for strength reasons its maximum thickness at the position of its support flange 15 is often about 170 mm. Because of its large thickness, the height of the equator profile 13 is usually minimized in order to facilitate machining and bending of the profile. The inner diameter of the intermediate portion 10 is equal to the inner diameter of the upper edge 13' of the equator profile 13 and to the inner diameter of the lower edge 11' of the top portion 11 of the tank. This provides favorable joints between the intermediate portion 10 and the rest of the tank. As shown in FIG. 3, the plates of the intermediate portion 10 are thicker than the plates of the top portion 11 and are thinner than the plates of the bottom portion 12.

The invention is not limited to the embodiment shown, but several modifications thereof are feasible within the scope of the attached claims.

We claim:

1. A large ship comprising a hull and at least first and second cargo tanks each having a structure suitable for transportation of liquefied gas and having substantially semi-spherical bottom and top portions, each of substantially equal radius of curvature, the bottom portion and the top portion of each tank being respectively below and above an equator profile which forms a portion of the tank and includes means for supporting said tank in said hull, and wherein at least the second tank has an intermediate portion that is substantially cylindrical and of substantially equal internal radius of curvature to the equator profile of the second tank and is situated between the equator profile of the second tank and one of the semi-spherical portions of the second tank.

2. A ship according to claim 1, wherein the height of the intermediate portion of the second tank is 2–15% of its diameter.

3. A ship according to claim 2, wherein the height of the intermediate portion of the second tank is 4–8% of its diameter.

4. A ship according to claim 1, wherein the equator profile of each tank includes a flange, said flange being at least part of said means for supporting the tank in said hull, and the ship includes a tank skirt to which the flange is connected.

5. A ship according to claim 1, wherein the hull includes a support structure for the tanks, and wherein the equator profile of each tank includes a flange engaging the support structure, said flange being at least part of said means for supporting the tank in said hull.

6. A ship according to claim 1, wherein the top and bottom portions of the second cargo tank each have an internal radius of at least about 15 m.

7. A ship according to claim 6, wherein the top and bottom portions of the second cargo tank each have an internal radius of at least about 20 m.

8. A ship according to claim 1, having a bridge aft of the bow of the ship and wherein the first and second tanks are disposed between the bridge and the bow of the ship and the first tank is substantially spherical and is forward of the second tank.

9. A ship according to claim 8, comprising at least a third cargo tank disposed between the bridge and the second tank, wherein the third tank has substantially semi-spherical bottom and top portions, each of substantially equal radius of curvature to the bottom and top portions of the first and second tanks, the bottom portion and the top portion of the third tank being respectively below and above an equator profile which forms a portion of the third tank and includes means for supporting the third tank in the hull, and wherein the third tank has an intermediate portion that is substantially cylindrical and of substantially equal internal radius of curvature to the equator profile of the third tank, and the intermediate portion of the third tank is situated between the equator profile of the third tank and one of the semi-spherical portions of the third tank and has a greater height than the intermediate portion of the second tank.

10. A ship according to claim 9, wherein the intermediate portion of said third tank is situated between the equator profile of the third tank and the top portion thereof.

11. A ship according to claim 1, wherein each portion the second tank is made of metal plates, and the plate thickness of the intermediate portion of the second tank is greater than that of the top portion of the second tank and less than that of the bottom portion of the second tank.

12. A ship according to claim 1, wherein each tank is made of aluminum plates having a thickness of at least 20 mm.

13. A ship according to claim 12, wherein each tank is made of aluminum plates having a thickness of at least 30 mm.

14. A ship according to claim 1, wherein each portion of the second tank is made of aluminum plates having a thickness of at least 20 mm, and the intermediate portion is made of plates that are thicker than the plates of the top portion and thinner than the plates of the bottom portion.

15. A ship according to claim 14, wherein each portion of the second tank is made of aluminum plates having a thickness of at least 30 mm.

16. A ship according to claim 1, wherein each portion of the second tank is made of metal plates, and the plate thickness of the intermediate portion is greater than or equal to the maximum plate thickness of the top portion and smaller than or equal to the minimum plate thickness of the bottom portion.

17. A ship according to claim 16, wherein the metal plates of each portion of the tank are aluminum plates having a thickness of at least 20 mm.

18. A large ship comprising a hull and at least first and second cargo tanks for liquefied gas, wherein the first tank defines a substantially spherical interior space and the second tank comprises a bottom portion that defines a substantially semi-spherical interior space of substantially equal radius to the interior space of the first tank, a top portion that defines a substantially semi-spherical interior space of substantially equal radius to the interior space of the first tank, and an intermediate portion between the bottom and top portions and defining a substantially cylindrical interior space of substantially equal radius to the interior space of the first tank.

19. A ship according to claim 18, wherein the top and bottom portions of the second cargo tank each have an internal radius of at least about 15 m.

20. A ship according to claim 18, wherein the top and bottom portions of the second cargo tank each have an internal radius of at least about 20 m.

21. A ship according to claim 1, wherein the intermediate portion of said second tank is situated between the equator profile of the second tank and the top portion thereof.

* * * * *